US007698758B2

(12) United States Patent
Wootten, Jr.

(10) Patent No.: US 7,698,758 B2
(45) Date of Patent: Apr. 20, 2010

(54) FITTED COVERING HAVING DIAGONAL ELASTIC BANDS

(76) Inventor: Gerald E. Wootten, Jr., 298 County Rd. 1468, Cullman, AL (US) 35055

( * ) Notice: Subject to any disclaimer, the term of this patent is extended or adjusted under 35 U.S.C. 154(b) by 27 days.

(21) Appl. No.: 11/928,620

(22) Filed: Oct. 30, 2007

(65) Prior Publication Data

US 2009/0106902 A1 Apr. 30, 2009

(51) Int. Cl.
*A47G 9/04* (2006.01)

(52) U.S. Cl. ..... 5/497; 5/499

(58) Field of Classification Search ..... 5/494–499, 5/482

See application file for complete search history.

(56) References Cited

U.S. PATENT DOCUMENTS

| | | | | |
|---|---|---|---|---|
| 2,164,036 | A | 6/1939 | Lane | |
| 2,214,074 | A | 9/1940 | Clarke | 5/499 |
| 2,576,324 | A | 11/1951 | Wirt | |
| 2,662,234 | A | 12/1953 | Citron | |
| 3,010,114 | A | 11/1961 | Lipschultz | |
| 3,114,156 | A | 12/1963 | Cobb | 5/497 |
| 3,148,388 | A | 9/1964 | Espersen | |
| 4,192,032 | A | 3/1980 | Geraci | |
| 4,461,049 | A | 7/1984 | Hammond | 5/498 |
| 4,596,618 | A | 6/1986 | Hammond | 156/164 |
| 4,662,013 | A | 5/1987 | Harrison | |
| 4,703,530 | A | 11/1987 | Gusman | |
| 4,768,252 | A | 9/1988 | Ross | |
| 4,777,677 | A | 10/1988 | Dugan | |
| 4,825,489 | A | 5/1989 | Ross | 5/497 |
| 4,937,904 | A | 7/1990 | Ross | |
| 5,003,902 | A | 4/1991 | Benstock et al. | |
| 5,029,353 | A | 7/1991 | Kimball et al. | 5/497 |
| 5,287,574 | A | 2/1994 | Kardell et al. | |
| 5,479,664 | A | 1/1996 | Hollander | 5/499 |
| 5,513,403 | A * | 5/1996 | Wooten, Jr. | 5/497 |
| 6,983,500 | B2 | 1/2006 | Wootten | 5/497 |
| 7,032,262 | B2 | 4/2006 | Creech | |
| 2004/0031100 | A1 | 2/2004 | Creech | |
| 2004/0068794 | A1 | 4/2004 | Wootten | 5/497 |
| 2006/0107461 | A1 | 5/2006 | Wootten, Jr. | 5/497 |

FOREIGN PATENT DOCUMENTS

| | | |
|---|---|---|
| DE | 108979 | 8/1960 |
| EP | 0 425 466 | 2/1991 |

* cited by examiner

*Primary Examiner*—Fredrick Conley
(74) *Attorney, Agent, or Firm*—Dykema Gossett PLLC

(57) ABSTRACT

A fitted mattress covering for a mattress includes lower edge portions, which may be inverted J-shaped portions, mirror-image inverted J-shaped portions, portions that terminate at an end, or inverted U-shaped portions. The covering side and end portion lower edges may join one another to form a continuous lower edge of the covering. For the J-shaped portion, an elastic binding may be disposed under a downwards folded portion. The elastic binding may extend at least partially along the length of the lower edge of the covering. An elastic band may be disposed at each corner of the covering and extend diagonally across the associated corner and have opposite ends secured adjacent one of the side portions and adjacent one of the adjacent end portions, respectively. The bands may be secured in place by stitching and/or by supplementary securing means to ensure that the bands do not pull away from the covering.

2 Claims, 10 Drawing Sheets

FITTED COVERING HAVING DIAGONAL ELASTIC BANDS

RELATED APPLICATION

This application claims benefit of priority of U.S. application Ser. No. 10/992,677, filed Nov. 22, 2004, hereby incorporated by reference in its entirety.

BACKGROUND OF INVENTION a. Field of Invention

The invention relates generally to fitted coverings for mattresses, and, more particularly to an improved fitted covering having diagonally extending elastic bands at the corners thereof for holding the covering in place relative to the corners of the mattress.

b. Description of Related Art

In the art, there presently exist a variety of known fitted sheets for mattresses and the like. Such sheets typically employ an elastic binding at the lower edge of the sheets. For certain sheet designs, additional widthwise or diagonally extending elastic bands may be provided at the corners of the sheet. The elastic binding in conjunction with the elastic bands facilitates fitting of the sheet on mattresses of different sizes, and further eliminates wrinkles in the fitted sheet.

Although the elastic binding and elastic bands provide adequate retention onto a mattress, one drawback of existing band designs is that when a sheet is grasped to lift up the underlying mattress, significant forces may be applied to the diagonal bands at the corners of such sheets. If a sheet is primarily used to lift up an underlying mattress, the elastic bands may pull away from the sheet at the point of attachment, particularly since these elastic bands are quite strong and are not usually subject to tearing at an intermediate point thereof.

Therefore, an important consideration in the construction of such fitted sheets is to provide an economical and strong manner of attaching the corner elastic bands thereof to the lower edge portions of the sheet, which will ensure that the durability of the bands in use is based on the strength of the bands themselves and not on the strength of the interconnection between the bands and the sheet.

A known fitted sheet invented by the inventor of the fitted sheet disclosed herein is described in U.S. Pat. No. 5,513,403 ('403 patent), the disclosure of which is incorporated herein by reference. Referring to FIGS. 1 and 8 of the '403 patent, the fitted sheet disclosed in the '403 patent includes fitted sheet 20 mounted on a conventional rectangular mattress 10 having a bottom face 12 and an opposite upper face 14. Sheet 20 includes a top portion 22, opposite side portions 24 and opposite end portions 26. The side and end portions of sheet 20 have lower edge portions which terminate in lower edges, and as seen in FIGS. 2 and 3, each side portion 24 has a lower portion 24' which terminates in a lower edge 24".

As shown in FIGS. 2-4 of the '403 patent, an elastic binding 40 is formed of conventional material and is disposed around the continuous lower edge of sheet 20 and extends along the entire length of the lower edge of the sheet. Binding 40 further includes an inwardly facing surface 44 and an outwardly facing surface 46. Sheet 20 further includes four similar elastic bands 50, each of these bands extending diagonally across one of the corners of the sheet. As shown in FIG. 6, each band has one end thereof secured to one of the side portions of sheet 20 and the opposite end thereof secured to an adjacent end portion of the sheet.

Referring to FIG. 2, in order to secure an end of band 50 to a side portion of the sheet, the end 50' of band 50 is initially sandwiched between the inwardly facing surface of side portion 24 and binding 40, and is secured in place by the line of stitching 42. Each band 50 thus terminates in an end edge 50" which is disposed adjacent to the lower edge 24" of side portion 24. In order to ensure that the end of band 50 will not pull away from the sheet, a supplementary securing means in the form of a bar tack 54 is provided. Specifically, as shown in FIG. 3, the end of each band 50 is secured to the sheet by folding band 50 over the upper edge of binding 40 and then positioning it against the inwardly facing surface 44 of the binding. Bar tack 54 extends through the associated lower edge portion of side portion 24, through two layers of binding lying on opposite sides of the lower edge portion of side portion 24, and through two layers of band 50 lying on opposite sides of the inner part of the binding.

Based upon the construction discussed above, if sheet 20 is primarily used to lift up the underlying mattress, elastic band 50 will separate at an intermediate point and be destroyed before the ends of the band will tear away from the sheet.

Although the fitted sheet construction described in the '403 patent has adequate strength at the connection points of the diagonal elastic bands for most operations, in certain situations and during certain abnormal use, elastic band 50 may be yanked loose from the fitted sheet and thus tear the sheet at the connection point. For certain manufacturing requirements, the fitted sheet construction described in the '403 patent may be economically prohibitive to manufacture. Additionally, for certain fit and finish requirements, the fitted sheet construction described in the '403 patent may have an insufficient wrinkle-free fit and finish.

There thus remains a need for an improved fitted sheet having diagonally extending elastic bands at the corners thereof, with the elastic bands being connected by an improved connection method so that the bands remain connected to the sheet despite being subjected to abnormal use. Moreover, compared to the elastic bands and connection techniques disclosed in the '403 patent, there also remains a need for an improved fitted sheet having diagonally extending elastic bands which are simpler to connect and utilize less raw material, and the fitted sheets are simpler and more economical to manufacture, and are ergonomically superior to those of the '403 patent.

SUMMARY OF INVENTION

The invention solves the problems and overcomes the drawbacks and deficiencies of prior art fitted sheets by providing an improved fitted covering having diagonally extending elastic bands at the corners thereof, with the elastic bands having superior strength and durability than those of the prior art.

Thus an object of the of the present invention is to provide an improved fitted covering having a snug fit under any mattress so as to provide a neat, tight look with smooth corners when in the operative position.

Another object of the present invention is to provide an improved fitted covering which may be easily put on a mattress, but will not accidentally pop off even when raising one end of a heavy mattress by lifting two corners of the covering.

Yet another object of the present invention is to provide an improved fitted covering having diagonally extending elastic bands being connected by an improved connection method so that the bands remain connected to the covering despite being subjected to abnormal use, and diagonally extending elastic bands which are simpler to connect, utilize less raw material, and are ergonomically superior to those of the prior art.

The invention achieves the aforementioned exemplary aspects by providing a fitted mattress covering being either a fitted sheet, a fitted mattress pad or other fitted bed clothing for a mattress, the covering including a fabric body having a top portion, side portions and end portions. The side and end portions may have lower edge portions defined by fabric from the side or end portions folded upwards to a first length and folded downwards to a second length, with the first length being greater than the second length. The upwards and downwards folded portions may generally define an inverted J-shaped or U-shaped portion. The side and end portion lower edges may be joined together to form a continuous lower edge of the covering. An elastic binding may be disposed under the downwards folded portion and thereby partially enclosed by the downwards folded portion. The elastic binding may extend at least partially along the length of the lower edge of the covering. The binding may be secured to the lower edge portions by stitching. An elastic band may be disposed at each corner of the covering. Each band may extend diagonally across the associated corner and have opposite ends secured adjacent one of the side portions and adjacent one of the adjacent end portions, respectively. The bands may be secured in place by the stitching and/or by supplementary securing means to ensure that the bands do not pull away from the covering.

For the fitted covering described above, each end of each of the bands may be sandwiched between one of the lower edge portions and the binding, and may terminate in an end edge which is disposed adjacent the lower edge of the covering. Each end of each of the bands may be folded over an upper end of the downwards folded portion and downwards against an inner layer of the lower edge portion. The supplementary securing means for each end of each of the bands may include a secure stitch extending through the folded layer of the band, the inner layer of the lower edge portion, the binding, the layer of the band sandwiched between one of the lower edge portions and the binding, and an outer layer of the lower edge portion.

In an alternative configuration, for the fitted covering described above, each end of each of the bands may be sandwiched between one of the lower edge portions and the binding, and terminate in an end edge which is disposed adjacent the lower edge of the covering. The supplementary securing means for each end of each of the bands may include a secure stitch extending through the inner layer of the lower edge portion, the binding, the layer of the band sandwiched between one of the lower edge portions and the binding, and an outer layer of the lower edge portion.

In another alternative configuration, each end of each of the bands may be disposed adjacent an inner layer of the lower edge portion and terminate in an end edge which is disposed adjacent the lower edge of the covering. Each end of each of the bands may be folded over in a generally U-shaped or inverted U-shaped configuration. The supplementary securing means for each end of each of the bands may include a secure stitch extending through the two folded layers of the band, the inner layer of the lower edge portion, the binding, and an outer layer of the lower edge portion.

In yet another alternative configuration, each end of each of the bands may be disposed adjacent an inner layer of the lower edge portion and terminate in an end edge which is disposed adjacent an upper or lower edge of the downwards folded portion. The supplementary securing means for each end of each of the bands may include a secure stitch extending through a layer of the hand, the inner layer of the lower edge portion, the binding, and an outer layer of the lower edge portion.

The invention yet further provides a fitted mattress covering being either a fitted sheet, a fitted mattress pad or other fitted bed clothing for a mattress, the covering including a fabric body having a top portion, side portions and end portions. The side and end portions may have lower edge portions defined by fabric from the side or end portions terminating at a lower edge. A cloth binding may include an inner inverted J-shaped or U-shaped portion and an outer mirror-image inverted J-shaped or U-shaped portion. Each of the J-shaped or U-shaped portions may be made of a fabric material folded upwards to a first length and folded downwards to a second length, with the first length being greater than the second length. The side and end portion lower edges may join one another to form a continuous lower edge of the covering. An elastic binding may be disposed under the downwards folded portion of the inner J-shaped or U-shaped portion and thereby partially enclosed by the downwards folded portion. The elastic binding may extend at least partially along the length of the lower edge of the covering, the binding being secured to the lower edge portions by stitching. An elastic band may be disposed at each corner of the covering. Each band may extend diagonally across the associated corner and have opposite ends secured adjacent one of the side portions and adjacent one of the adjacent end portions, respectively. The bands may be secured in place by the stitching and/or by supplementary securing means to ensure that the bands do not pull away from the covering.

For the fitted covering described above, each end of each of the bands may be sandwiched between one of the lower edge portions and the binding, and terminate in an end edge which is disposed adjacent the lower edge of the covering. Each end of each of the bands may be folded over an upper end of the downwards folded portion and downwards against an inner layer of the lower edge portion. The supplementary securing means for each end of each of the bands may include a secure stitch extending through a folded layer of the band, a layer of the inner J-shaped or U-shaped portion, the binding, the layer of the band sandwiched between one of the lower edge portions and the binding, a layer of the lower edge portion, and a layer of the outer J-shaped or U-shaped portion.

In an alternative configuration, each end of each of the bands may be sandwiched between one of the lower edge portions and the binding, and terminate in an end edge which is disposed adjacent the lower edge of the covering. The supplementary securing means for each end of each of the bands may include a secure stitch extending through a layer of the inner J-shaped or U-shaped portion, the binding, the layer of the band sandwiched between one of the lower edge portions and the binding, a layer of the lower edge portion, and a layer of the outer J-shaped or U-shaped portion.

In another alternative configuration, each end of each of the bands may be disposed adjacent the inner J-shaped or U-shaped portion and terminate in an end edge which is disposed generally adjacent the lower edge of the covering. Each end of each of the bands may be folded over in a generally U-shaped or inverted U-shaped configuration. The supplementary securing means for each end of each of the bands may include a secure stitch extending through the two folded layers of the band, a layer of the inner J-shaped or U-shaped portion, the binding, a layer of the lower edge portion, and a layer of the outer J-shaped or U-shaped portion.

In yet another alternative configuration, each end of each of the bands may be disposed adjacent the inner J-shaped or U-shaped portion and terminate in an end edge which is disposed adjacent an upper or lower edge of the downwards folded portion. The supplementary securing means for each end of each of the bands may include a secure stitch extending through a layer of the band, a layer of the inner J-shaped or U-shaped portion, the binding, a layer of the lower edge portion, and a layer of the outer J-shaped or U-shaped portion.

The invention also provides a fitted mattress covering being either a fitted sheet, a fitted mattress pad or other fitted bed clothing for a mattress, the covering including, a fabric body having a top portion, side portions and end portions. The side and end portions may have lower edge portions defined by fabric from the side or end portions folded upwards to a first length and folded downwards to a second length, with the first length being substantially the same as the second length. The upwards and downwards folded portions generally define an inverted U-shaped or J-shaped portion. The side and end portion lower edges may join one another to form a continuous lower edge of the covering. An elastic binding may be disposed adjacent the downwards folded portion, and extend at least partially along the length of the lower edge of the covering. The binding may be secured to the lower edge portions by stitching. An elastic band may be disposed at each corner of the covering. Each band may extend diagonally across the associated corner and have opposite ends secured adjacent one of the side portions and adjacent one of the adjacent end portions, respectively. The bands may be secured in place by the stitching and/or by supplementary securing means to ensure that the bands do not pull away from the covering.

For the fitted covering described above, each end of each of the bands may be sandwiched between one of the lower edge portions and the binding, and terminate in an end edge which is disposed adjacent the lower edge of the covering. Each end of each of the bands may be folded over an upper end of the downwards folded portion and downwards against an inner layer of the lower edge portion. The supplementary securing means for each end of each of the bands may include a secure stitch extending through a folded layer of the band, the layer (s) of the U-shaped or J-shaped portions, the binding, the layer of the band sandwiched between one of the lower edge portions and the binding, and an outer layer of the lower edge portion.

In an alternative configuration, each end of each of the bands may be sandwiched between one of the lower edge portions and the binding, and terminate in an end edge which is disposed adjacent the lower edge of the covering. The supplementary securing means for each end of each of the bands may include a secure stitch extending through the layer(s) of the U-shaped or J-shaped portions, the binding, the layer of the band sandwiched between one of the lower edge portions and the binding, and an outer layer of the lower edge portion.

In another alternative configuration, each end of each of the bands may be disposed adjacent an inner layer of the lower edge portion, and terminate in an end edge which is disposed generally adjacent the lower edge of the covering. Each end of each of the bands may be folded over in a generally U-shaped or inverted U-shaped configuration. The supplementary securing means for each end of each of the bands may include a secure stitch extending through the two folded layers of the band, the layer(s) of the U-shaped or J-shaped portions, the binding, and an outer layer of the lower edge portion.

In yet another alternative configuration, each end of each of the bands may be disposed adjacent an inner layer of the lower edge portion and terminate in an end edge which is disposed adjacent an upper or lower edge of the downwards folded portion. The supplementary securing means for each end of each of the bands may include a secure stitch extending through an associated layer of the band, the layer(s) of the U-shaped or J-shaped portions, the binding, and an outer layer of the lower edge portion.

The invention yet further provides a fitted mattress covering being either a fitted sheet, a fitted mattress pad or other fitted bed clothing for a mattress, the covering including a fabric body having a top portion, side portions and end portions. The side and end portions may have lower edge portions defined by fabric from the side or end portions terminating at a lower edge. The side and end portion lower edges may join one another to form a continuous lower edge of the covering. An elastic binding may be disposed adjacent the lower edge portion, and extend at least partially along the length of the lower edge of the covering. The binding may be secured to the lower edge portions by stitching. An elastic band may be disposed at each corner of the covering. Each band may extend diagonally across the associated corner and have opposite ends secured adjacent the elastic binding disposed adjacent the side portions and adjacent one of the adjacent end portions, respectively. The bands may be secured in place by the stitching and/or by supplementary securing means to ensure that the bands do not pull away from the covering.

For the fitted covering described above, the stitching may be serge stitching. Each end of each of the bands may terminate in an end edge which is disposed adjacent the lower edge of the covering. Each end of each of the bands may be folded over in a generally U-shaped or inverted U-shaped configuration. The supplementary securing means for each end of each of the bands may include a secure stitch extending through the two folded layers of the band, the binding, and a layer of the lower edge portion.

In an alternative configuration, each end of each of the bands may terminate in an end edge which is disposed adjacent an upper or lower end of the elastic binding. The supplementary securing means for each end of each of the bands may include a secure stitch extending through a layer of the band, the binding, and a layer of the lower edge portion.

The invention also provides a fitted mattress covering being either a fitted sheet, a fitted mattress pad or other fitted bed clothing for a mattress. The covering may include a fabric body having a top portion, side portions and end portions. The side and end portions may have lower edge portions defined by fabric from the side or end portions terminating at a lower edge. The side and end portion lower edges may join one another to form a continuous lower edge of the covering. An elastic binding may be disposed in a folded configuration on inner and outer sides of the lower edge of the covering thereby defining inner and outer elastic binding layers. The elastic binding may extend at least partially along the length of the lower edge of the covering. The binding may be secured to the lower edge portions by stitching. An elastic band may be disposed at each corner of the covering. Each band may extend diagonally across the associated corner and have opposite ends secured adjacent one of the side portions and adjacent one of the adjacent end portions, respectively. The bands may be secured in place by at least one of the stitching and by supplementary securing means to ensure that the bands do not pull away from the covering.

For the fitted covering described above, each end of each of the bands may be sandwiched between one of the lower edge portions and the binding and terminate in an end edge which is disposed adjacent the lower edge of the covering. The supplementary securing means for each end of each of the bands may include a secure stitch extending through the inner elastic binding layer, the layer of the band sandwiched between one of the lower edge portions and the binding, a layer of the lower edge portion, and the outer elastic binding layer.

In an alternative configuration, each end of each of the bands may be disposed adjacent the inner elastic binding layer and terminate in an end edge which is disposed generally adjacent the lower edge of the covering. Each end of each of the bands may be folded over in a generally U-shaped or inverted U-shaped configuration. The supplementary securing means for each end of each of the bands may include a secure stitch extending through the two folded layers of the band, the inner elastic binding layer, a layer of the lower edge portion, and the outer elastic binding layer.

In another alternative configuration, each end of each of the bands may be disposed adjacent the inner elastic binding layer and terminate in an end edge which is disposed adjacent an upper or lower edge of the inner elastic binding layer. The supplementary securing means for each end of each of the bands may include a secure stitch extending through a layer of the band, the inner elastic binding layer, a layer of the lower edge portion, and the outer elastic binding layer.

Additional features, advantages, and embodiments of the invention may be set forth or apparent from consideration of the following detailed description, drawings, and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detail description serve to explain the principles of the invention. In the drawings:

FIG. 2(*b*) is an enlarged perspective section through the lower part of a corner of the first embodiment of the fitted covering of FIG. 2(*a*), showing the manner in which the end of an elastic band may be initially inserted and secured in place by stitching, and thereafter folded over and disposed against the inwardly facing folded surface of the covering fabric and secured thereto by a secure stitch;

FIG. 2(*c*) is an enlarged perspective section through the lower part of a corner of an alternative first embodiment of the fitted covering of FIG. 2(*a*), showing the manner in which the end of an elastic band may be inserted and secured in place by stitching and a secure stitch;

FIG. 2(*d*) is an enlarged perspective section through the lower part of a corner of another alternative first embodiment of the fitted covering of FIG. 2(*a*), showing the manner in which an elastic band may be folded over and disposed against the inwardly facing folded surface of the covering fabric and secured thereto by a secure stitch;

FIG. 2(*e*) is an enlarged perspective section through the lower part of a corner of yet another alternative first embodiment of the fitted covering of FIG. 2(*a*), showing the manner in which an elastic band may be disposed against the inwardly facing folded surface of the covering fabric and secured thereto by a secure stitch;

FIG. 2(*f*) is an enlarged perspective section through the lower part of a corner of another alternative first embodiment of the fitted covering of FIG. 2(*a*), showing an alternative manner in which an elastic band may be folded over and disposed against the inwardly facing folded surface of the covering fabric and secured thereto by a secure stitch;

FIG. 2(*g*) is an enlarged perspective section through the lower part of a corner of yet another alternative first embodiment of the fitted covering of FIG. 2(*a*), showing an alternative manner in which an elastic band may be disposed against the inwardly facing folded surface of the covering fabric and secured thereto by a secure stitch;

FIG. 3(*b*) is an enlarged perspective section through the lower part of a corner of the second embodiment of the fitted covering of FIG. 3(*a*), showing the manner in which the end of an elastic band may be initially inserted and secured in place by stitching, and thereafter folded over and disposed against the inwardly facing J-shaped section and secured thereto by a secure stitch;

FIG. 3(*c*) is an enlarged perspective section through the lower part of a corner of an alternative second embodiment of the fitted covering of FIG. 3(*a*), showing the manner in which the end of an elastic band may be inserted and secured in place by stitching and a secure stitch;

FIG. 3(*d*) is an enlarged perspective section through the lower part of a corner of another alternative second embodiment of the fitted covering of FIG. 3(*a*), showing the manner in which an elastic band may be folded over and disposed against the inwardly facing J-shaped section and secured thereto by a secure stitch;

FIG. 3(*e*) is an enlarged perspective section through the lower part of a corner of yet another alternative second embodiment of the fitted covering of FIG. 3(*a*), showing the manner in which an elastic band may be disposed against the inwardly facing J-shaped section and secured thereto by a secure stitch;

FIG. 3(*f*) is an enlarged perspective section through the lower part of a corner of another alternative second embodiment of the fitted covering of FIG. 3(*a*), showing an alternative manner in which an elastic band may be folded over and disposed against the inwardly facing folded surface of the covering fabric and secured thereto by a secure stitch;

FIG. 3(*g*) is an enlarged perspective section through the lower part of a corner of yet another alternative second embodiment of the fitted covering of FIG. 3(*a*), showing an alternative manner in which an elastic band may be disposed against the inwardly facing J-shaped section and secured thereto by a secure stitch;

FIG. 4(*b*) is an enlarged perspective section through the lower part of a corner of the third embodiment of the fitted covering of FIG. 4(*a*), showing the manner in which the end of an elastic band may be initially inserted and secured in place by stitching, and thereafter folded over and disposed against the inwardly facing folded surface of the covering fabric and secured thereto by a secure stitch;

FIG. 4(*c*) is an enlarged perspective section through the lower part of a corner of an alternative third embodiment of the fitted covering of FIG. 4(*a*), showing the manner in which the end of an elastic band may be inserted and secured in place by stitching and a secure stitch;

FIG. 4(*d*) is an enlarged perspective section through the lower part of a corner of another alternative third embodiment of the fitted covering of FIG. 4(*a*), showing the manner in which an elastic band may be folded over and disposed against the inwardly facing folded surface of the covering fabric and secured thereto by a secure stitch;

FIG. 4(*e*) is an enlarged perspective section through the lower part of a corner of yet another alternative third embodiment of the fitted covering of FIG. 4(*a*), showing the manner in which an elastic band may be disposed against the inwardly facing folded surface of the covering fabric and secured thereto by a secure stitch;

FIG. 4(*f*) is an enlarged perspective section through the lower part of a corner of another alternative third embodiment of the fitted covering of FIG. 4(*a*), showing an alternative manner in which an elastic band may be folded over and disposed against the inwardly facing folded surface of the covering fabric and secured thereto by a secure stitch;

FIG. 4(*g*) is an enlarged perspective section through the lower part of a corner of yet another alternative third embodiment of the fitted covering of FIG. 4(*a*), showing an alternative manner in which an elastic band may be disposed against the inwardly facing folded surface of the covering fabric and secured thereto by a secure stitch;

FIG. 5(*b*) is an enlarged perspective section through the lower part of a corner of a fourth embodiment of the fitted covering of FIG. 5(*a*), showing the manner in which an elastic band may be folded over and disposed against the elastic binding and secured to the covering by a secure stitch;

FIG. 5(*c*) is an enlarged perspective section through the lower part of a corner of an alternative fourth embodiment of the fitted covering of FIG. 5(*a*), showing the manner in which an elastic band may be disposed against the elastic binding and secured to the covering by a secure stitch;

FIG. 5(*d*) is an enlarged perspective section through the lower part of a corner of a fourth embodiment of the fitted covering of FIG. 5(*a*), showing an alternative manner in which an elastic band may be folded over and disposed against the elastic binding and secured to the covering by a secure stitch;

FIG. 5(*e*) is an enlarged perspective section through the lower part of a corner of an alternative fourth embodiment of the fitted covering of FIG. 5(*a*), showing an alternative manner in which an elastic band may be disposed against the elastic binding and secured to the covering by a secure stitch;

FIG. 5(*f*) is an enlarged perspective section through the lower part of a corner of an alternative fourth embodiment of the fitted covering of FIG. 5(*a*), showing an alternative manner in which an elastic band may be disposed between the elastic binding and the covering, and secured to the covering by a secure stitch;

FIG. 6(*b*) is an enlarged perspective section through the lower part of a corner of an alternative fifth embodiment of the fitted covering of FIG. 6(*a*), showing the manner in which the end of an elastic band may be inserted and secured in place by stitching and a secure stitch;

FIG. 6(*c*) is an enlarged perspective section through the lower part of a corner of another alternative fifth embodiment of the fitted covering of FIG. 6(*a*), showing the manner in which an elastic band may be folded over and disposed against the inwardly facing folded surface of the elastic binding and secured thereto by a secure stitch;

FIG. 6(*d*) is an enlarged perspective section through the lower part of a corner of yet another alternative fifth embodiment of the fitted covering of FIG. 6(*a*), showing the manner in which an elastic band may be disposed against the inwardly facing folded surface of the elastic binding and secured thereto by a secure stitch;

FIG. 6(*e*) is an enlarged perspective section through the lower part of a corner of another alternative fifth embodiment of the fitted covering of FIG. 6(*a*), showing an alternative manner in which an elastic band may be folded over and disposed against the inwardly facing folded surface of the elastic binding and secured thereto by a secure stitch;

FIG. 6(*f*) is an enlarged perspective section through the lower part of a corner of yet another alternative fifth embodiment of the fitted covering of FIG. 6(*a*), showing an alternative manner in which an elastic band may be disposed against the inwardly facing folded surface of the elastic binding and secured thereto by a secure stitch;

DETAILED DESCRIPTION OF THE PREFERRED EMBODIMENT

Figure 1:
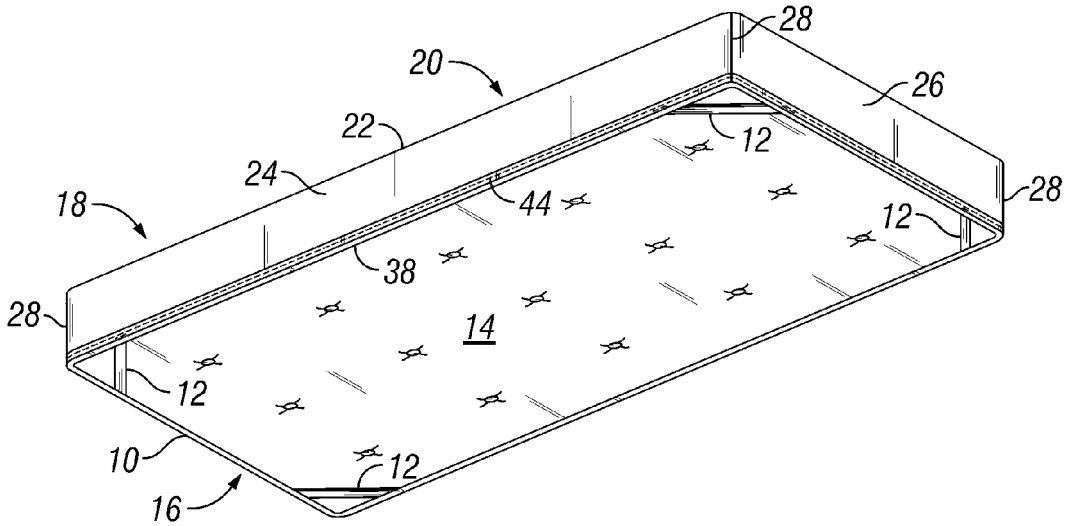
FIG. 1 is a bottom perspective view of a mattress having a fitted covering according to the present invention mounted thereon.
Figure 7:
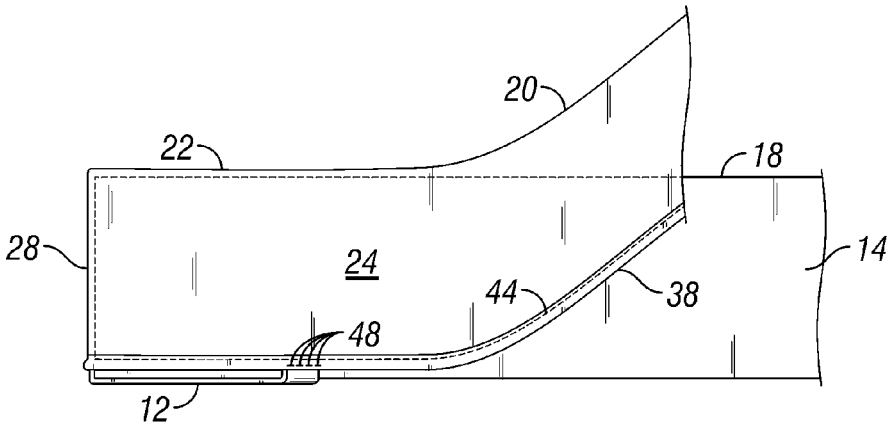
FIG. 7 is a view showing the manner in which a corner of the covering is mounted on a mattress.
Figure 9:
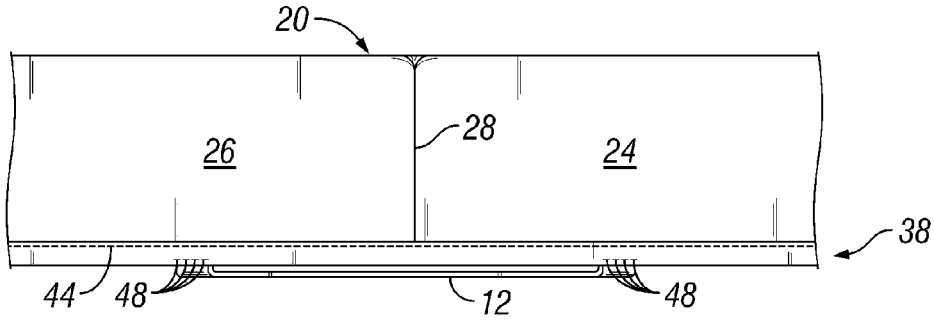
FIG. 9 is an elevation showing one of the corners of the covering when mounted on a mattress.
Figure 2A:
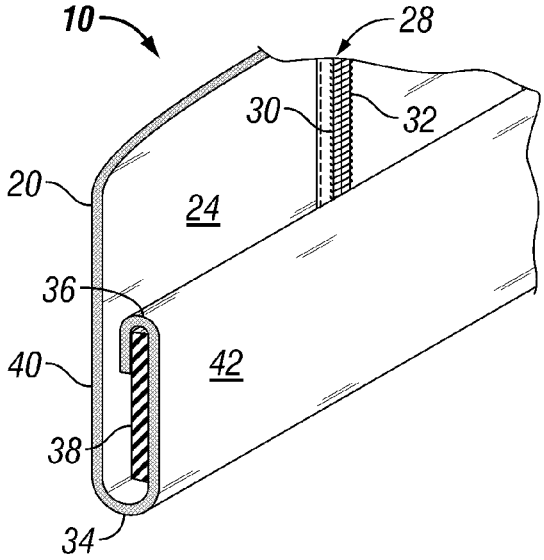
FIG. 2(*a*) is an enlarged perspective section through the lower part of a corner of a first embodiment of the fitted covering of FIG. 1, showing the manner in which the covering fabric is folded inwardly in a J-shaped configuration over the elastic binding.
Figure 2B:
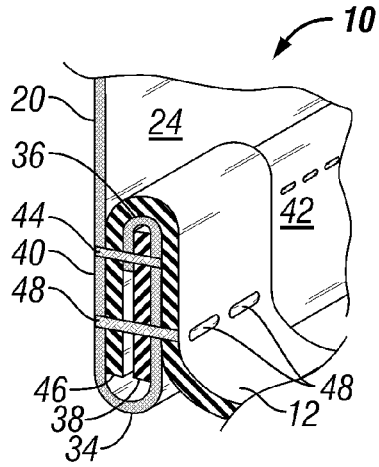
Figure 2C:
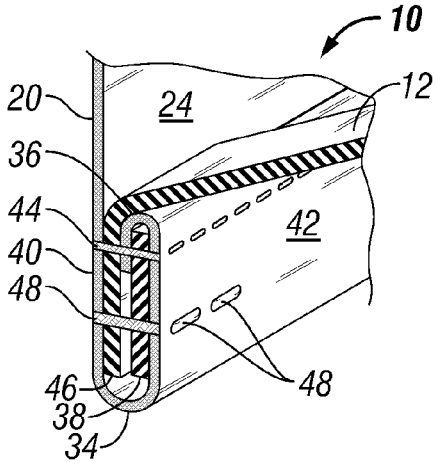
Figure 2D:
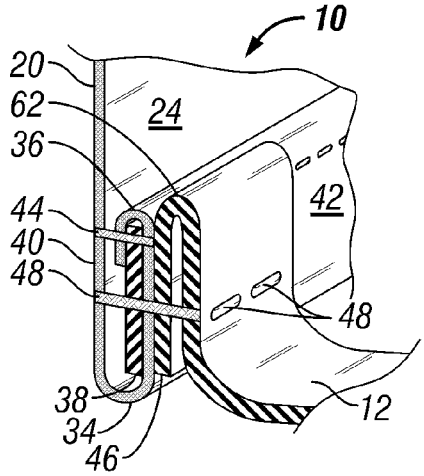
Figure 2E:
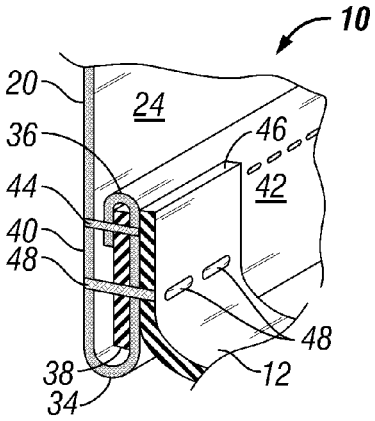
Figure 2F:
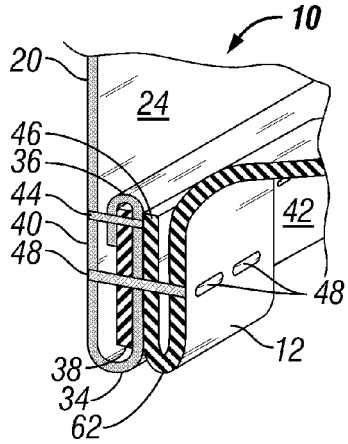
Figure 2G:
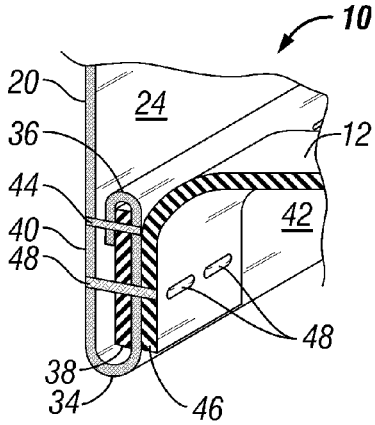
Figure 3A:
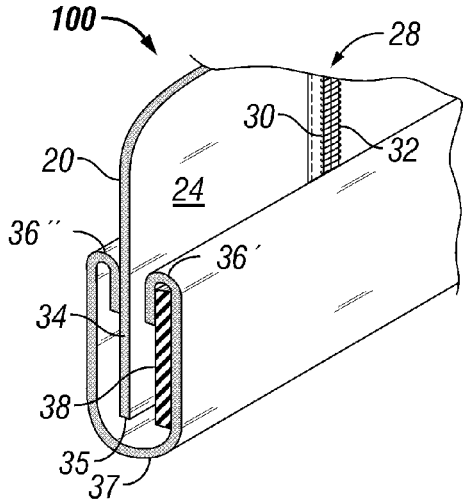
FIG. 3(*a*) is an enlarged perspective section through the lower part of a corner of a second embodiment of the fitted covering of FIG. 1, showing the manner in which the covering fabric is disposed between mirror-image J-shaped cloth bindings, wherein the inwardly facing J-shaped section is folded over the elastic binding.
Figure 3B:
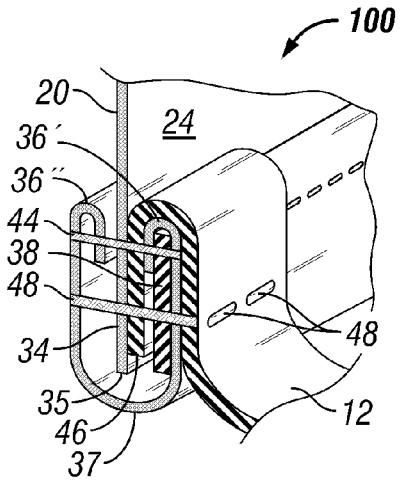
Figure 3C:
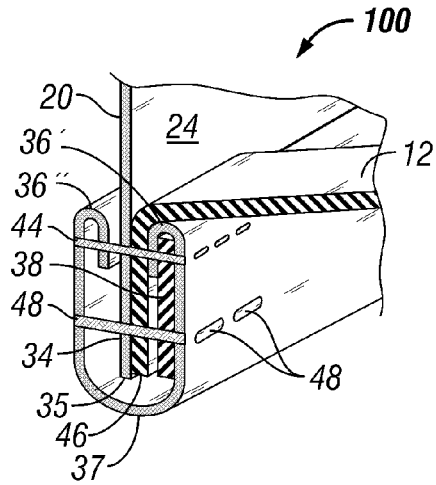
Figure 3D:
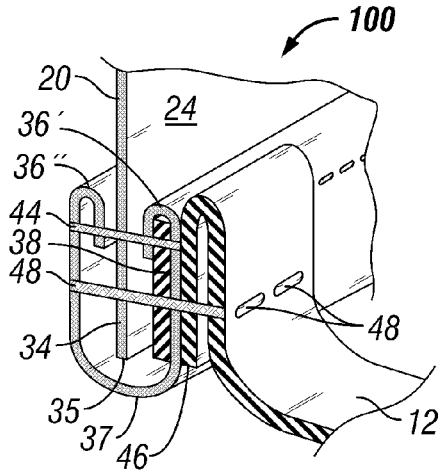
Figure 3E:
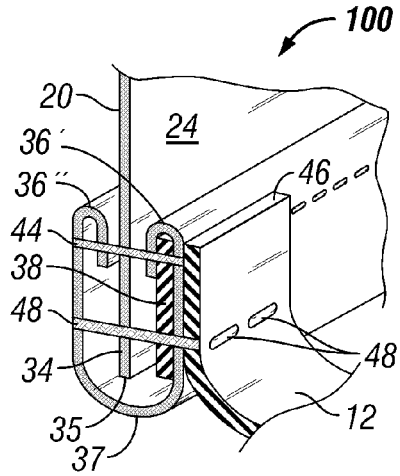
Figure 3F:
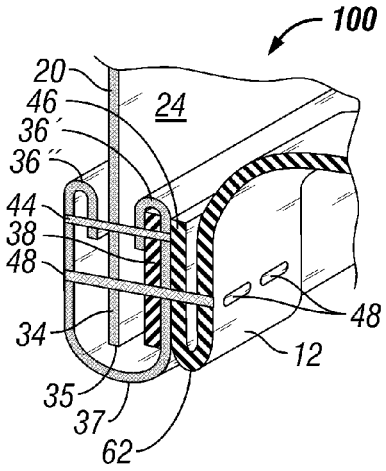
Figure 3G:
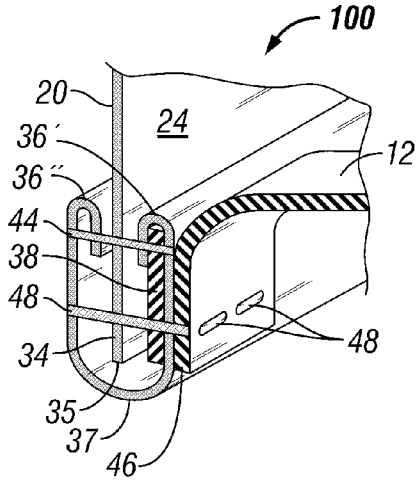
Figure 4A:
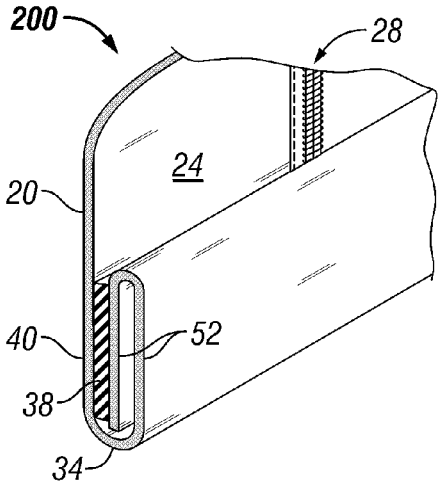
FIG. 4(*a*) is an enlarged perspective section through the lower part of a corner of a third embodiment of the fitted covering of FIG. 1, showing the manner in which the covering fabric is folded inwardly and disposed against an inwardly facing surface of the elastic binding.
Figure 4B:
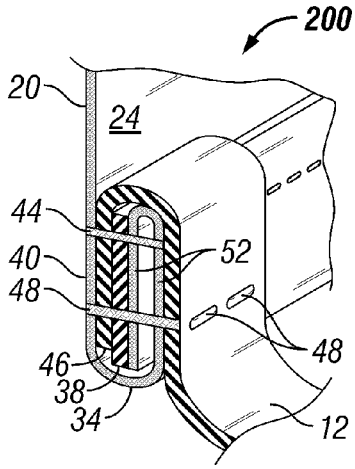
Figure 4C:
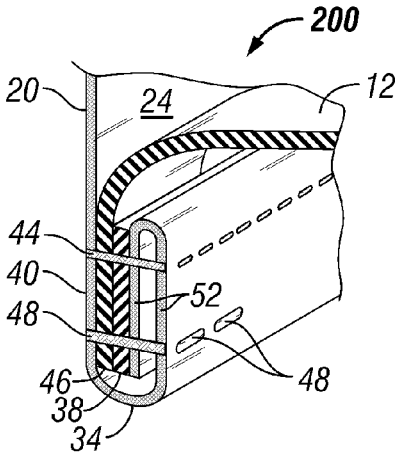
Figure 4D:
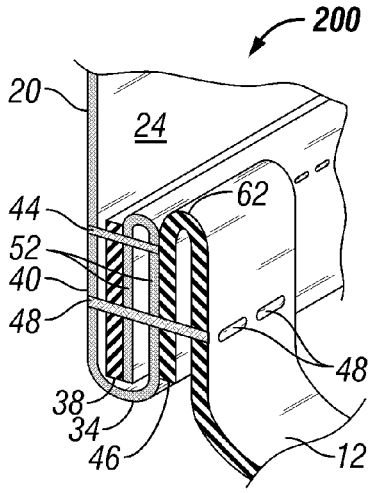
Figure 4E:
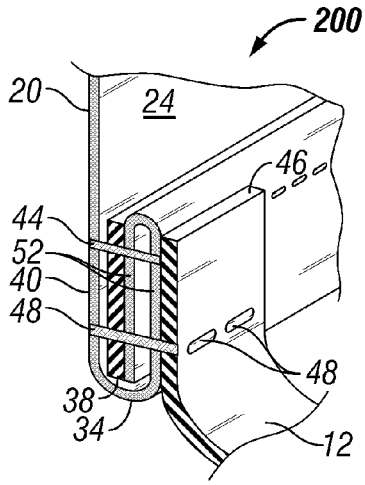
Figure 4F:
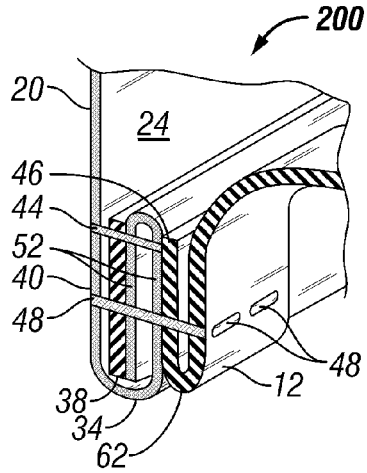
Figure 4G:
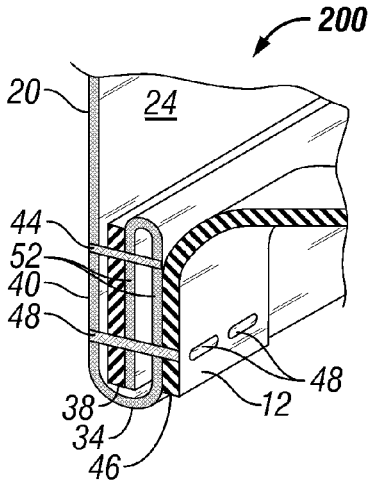
Figure 5A:
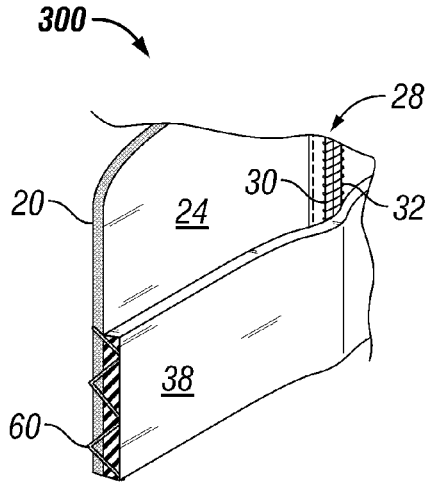
FIG. 5(*a*) is an enlarged perspective section through the lower part of a corner of a fourth embodiment of the fitted covering of FIG. 1, showing the manner in which the covering fabric extends downwardly and includes the elastic binding attached thereto by a serge stitch.
Figure 5B:
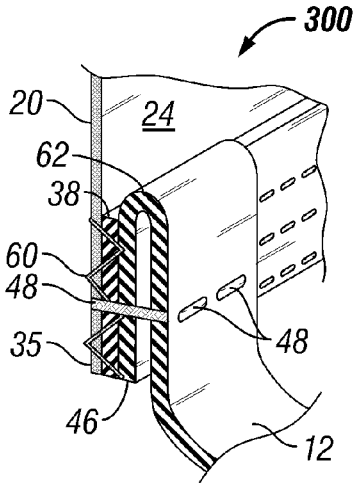
Figure 5C:
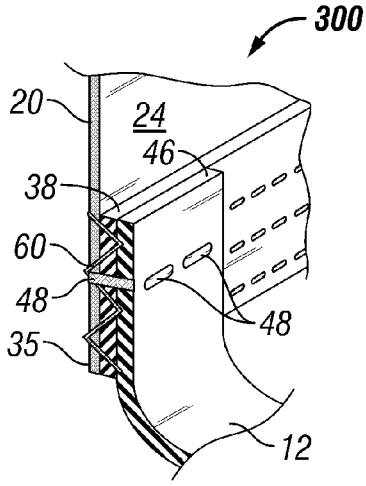
Figure 5D:
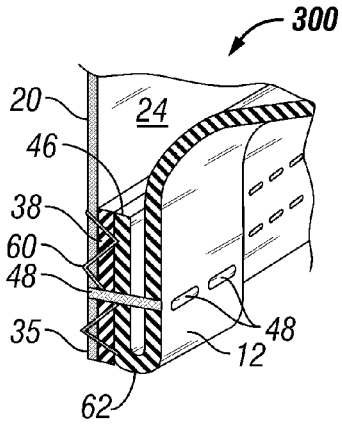
Figure 5E:
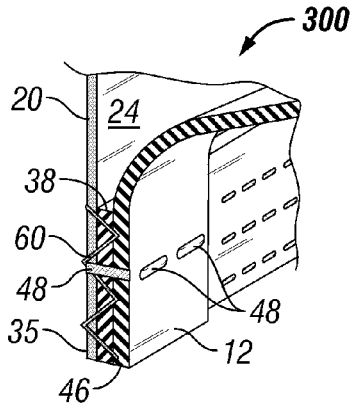
Figure 5F:
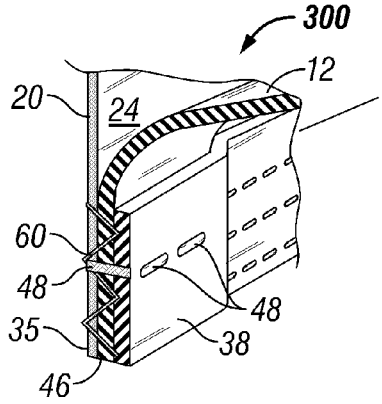
Figure 6A:
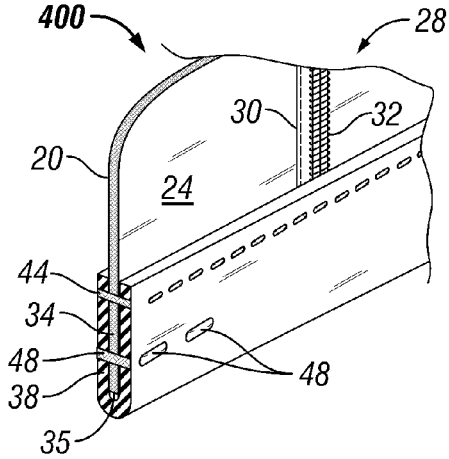
FIG. 6(*a*) is an enlarged perspective section through the lower part of a corner of a fifth embodiment of the fitted covering of FIG. 1, showing the manner in which the covering fabric extends downwardly and includes the elastic binding attached thereto on inner and outer sides thereof.
Figure 6B:
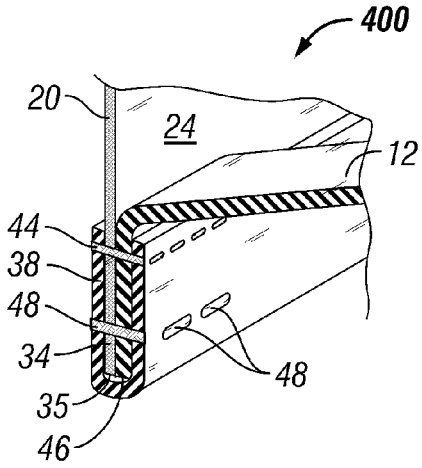
Figure 6C:
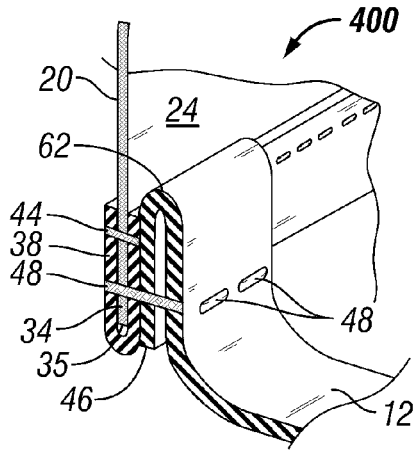
Figure 6D:
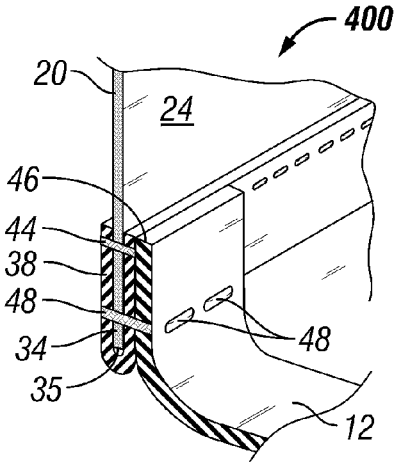
Figure 6E:
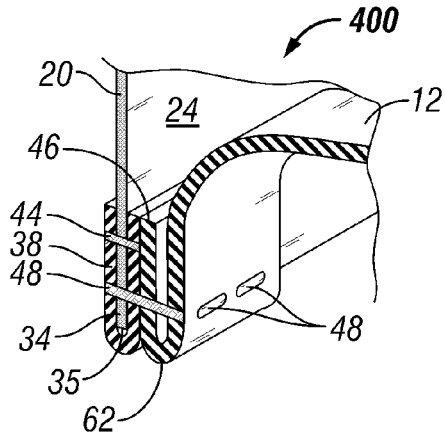
Figure 6F:
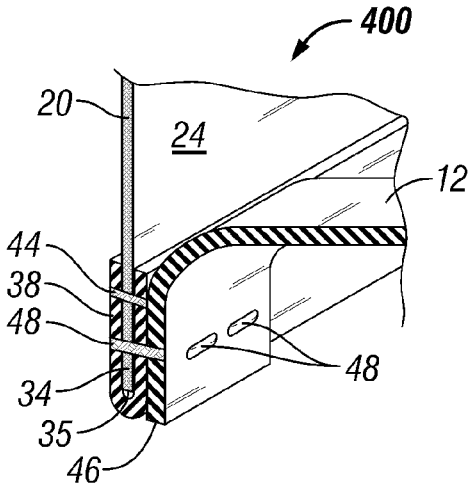
Figure 8:
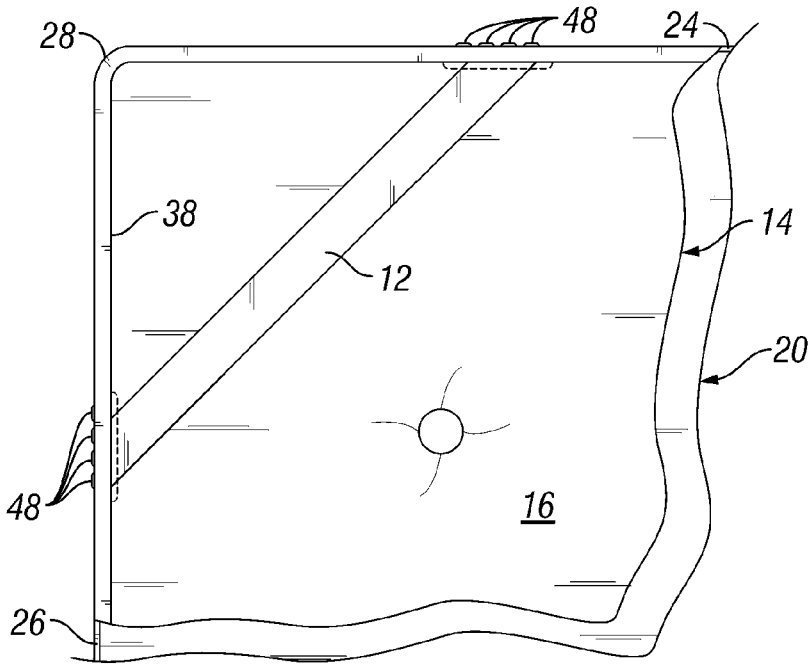
FIG. 8 is a bottom view of one of the corners of the covering when mounted on a mattress.

Referring now to the drawings wherein like reference numerals designate corresponding parts throughout the several views, FIGS. 1-9 illustrate first through fourth embodiments of an improved fitted covering having diagonally extending elastic bands at the corners thereof according to the present invention, the embodiments being respectively designated 10, 100, 200, 300 and 400.

With reference to FIGS. 1, 2(*a*)-2(*g*) and 7-9, the first embodiment of fitted covering 10 will now be described in detail.

Specifically, as shown in FIG. 1, fitted covering 10 including a plurality of diagonal elastic bands 12 is illustrated as being mounted on a conventional rectangular mattress 14 having a bottom face 16 and an opposite upper face is. Fitted covering 10 generally comprises a body 20 formed of any suitable fabric such as cotton, a cotton blend or satin and the like. Body 20 may include a top portion 22, opposite side portions 24 and opposite end portions 26. Adjacent side and end portions may be seamed together in the usual manner at four seams to form four vertical corners 28. As seen in FIG. 2(*a*), each seam defining a vertical corner may include a straight line of stitching 30 and a conventional overlock, safety stitch 32 or other seam securing methods. The same may be applicable to the horizontal corners (not shown) of covering 10. Alternatively, a variety of other horizontal or vertical corner formation methods known in the art may be used. Moreover, for the fitted covering described herein, instead of vertical or horizontal corners, fitted covering 10 may be of the "cornerless" variety, wherein a single or plural layers of fabric may form the cornerless fitted covering.

Referring to FIG. 2(*a*), each side portion 24, and likewise each end portion 26, may include a bottom section 34 folded upwards in an inverted J-shaped configuration so as to form hook 36 for partially enclosing and firmly securing a single layer of elastic binding 38. It should be noted that instead of the inverted J-shaped configuration illustrated in FIG. 2(*a*), bottom section 34 may be folded upwards in an inverted U-shaped configuration (not shown). Elastic binding 38 may be formed of conventional material used for such elastic binding material in fitted coverings, and may be disposed around the continuous lower edge of the covering and extend at least partially along the length of the lower edge of the covering. Once secured under J-shaped hook 36 of side portion 24, as described in greater detail below, binding 38 may be secured adjacent outer layer 40 of side portion 24 and further to inner layer 42 adjacent hook 36 by means of stitching 44. Each end portion 26 of covering 10 may have a similar lower portion and lower edge, including the hook configuration described above. The lower edges of the side and end portions 24, 26, respectively, may extend lengthwise of the respective portions and may be spaced from top portion 22 of body 20. The lower edges of side portions 24 may be joined with the lower edges of end portions 26 to form a continuous lower edge of the covering.

With the general configuration of the first embodiment of covering 10 described above in reference to FIG. 2(*a*), the aforementioned J-shaped hook configuration will now be used as a basis for a description of the attachment method for elastic band 12.

Specifically, referring to FIGS. 2(*a*) and 2(*b*), before application of stitching 44 for securing binding 38 in place, for the embodiment of covering 10 illustrated in FIG. 2(*b*), end 46 of elastic band 12 may be initially inserted and sandwiched between the outer layer 40 of side portion 24 and elastic binding 38. With elastic band 12 and elastic binding 38 disposed as illustrated in FIG. 2(*b*), the entire assembly including outer layer 40 of side portion 24, elastic band 12, elastic binding 38 and the layer including J-shaped hook 36 may be stitched by stitching 44.

In order to ensure that end 46 of band 12 will not pull away from covering 10 during abnormal use, a supplementary securing means may be provided. Referring to FIG. 2(*b*), after stitching of band 12 by means of stitches 44, band 12 may be folded over the upper edge of J-shaped hook 36 and positioned against the inwardly facing surface of inner layer 42. In order to further secure elastic band 12, a secure stitch 48 comprising the supplementary securing means may then be formed by a conventional secure stitch machine so that the secure stitch extends through the first layer of elastic band 12, inner layer 42 of side portion 24, elastic binding 38, the layer including pre-inserted end 46 of band 12 and outer layer 40 of side portion 24. It should be noted that secure stitch 48 may include, for example, a bar tack, running tack, straight line stitch or cross-hair tack, extra stitching, or any other form of stitching for providing additional securing for attachment and retention of elastic band 12.

It is understood that each end of each of the bands 12 is secured to the associated lower portion of the covering with a construction as shown in FIG. 2(*b*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With this construction described above and illustrated in FIGS. 2(*a*) and 2(*b*), even during abnormal use such as yanking and the like, elastic band 12 will remain connected to the covering, and in only rare cases, separate at an intermediate point and be destroyed before the ends of the band will tear away from the covering. Moreover, the provision of the J-shaped hook 36 securely encloses elastic binding 38 to prevent binding 38 from becoming loose, and further encloses elastic binding 38 such that the outer fabric layer 40 of covering 10 has virtually no wrinkles to thereby provide a neat and secure fit on a mattress. Ergonomically, the construction of FIGS. 2(*a*) and 2(*b*) also provides a superior elastic fitted covering for which the outer fabric layer 40 encloses elastic band 12 and elastic binding 38, such that in addition to the wrinkle-free fit, elastic band 12 and elastic binding 38 are obscured from view from the general outer surface of covering 10.

A first alternative method of attachment of elastic band 12 for the first embodiment of fitted covering 10 will now be described in detail with reference to FIGS. 2(*a*) and 2(*c*).

Specifically, referring to FIGS. 2(*a*) and 2(*c*), as discussed for the elastic band attachment method of FIG. 2(*b*), before application of stitching 44 for securing binding 38 in place, for the embodiment of covering 10 illustrated in FIG. 2(*c*), end 46 of elastic band 12 may be initially inserted and sandwiched between the outer layer 40 of side portion 24 and elastic binding 38. With elastic band 12 and elastic binding 38 disposed as illustrated in FIG. 2(*c*), the entire assembly including outer layer 40 of side portion 24, elastic band 12, elastic binding 38 and the layer including J-shaped hook 36 may be stitched by stitching 44.

In order to ensure that end 46 of band 12 will not pull away from covering 10 during abnormal use, as discussed for the elastic band attachment method of FIG. 2(*b*), a supplementary securing means may be provided. Referring to FIG. 2(*c*), after stitching of band 12 by means of stitches 44, a secure stitch 48 comprising the supplementary securing means may be formed by a conventional secure stitch machine so that the secure stitch extends through inner layer 42 of side portion 24, elastic binding 38, the layer including pre-inserted end 46 of band 12 and outer layer 40 of side portion 24.

As with the construction of FIG. 2(*b*), it is understood that each end of each of the bands 12 is secured to the associated lower portion of the covering with a construction as shown in FIG. 2(*c*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

A second alternative method of attachment of elastic band 12 for the first embodiment of fitted covering 10 will now be described in detail with reference to FIGS. 2(*a*), 2(*d*) and 2(*f*).

Specifically, referring to FIGS. 2(*a*) and 2(*d*), after application of stitching 44 through the layer including J-shaped hook 36, elastic binding 38 and outer layer 40 of side portion 24, for the embodiment of covering 10 illustrated in FIG. 2(*d*), section 62 of elastic band 12 may be folded over against the inner layer 42 of covering 10. In order to ensure that end 46 of band 12 will not pull away from covering 10 during abnormal use, as discussed for the elastic band attachment method of FIG. 2(*b*), a supplementary securing means may be provided. Referring to FIG. 2(*d*), after stitching by means of stitches 44, a secure stitch 48 comprising the supplementary securing means may be formed by a conventional secure stitch machine so that the secure stitch extends through the folded over layers of elastic band 12, inner layer 42 of side portion 24, elastic binding 38, and outer layer 40 of side portion 24.

Compared to the embodiment of FIG. 2(*d*), for the embodiment of FIG. 2(*f*), elastic band 12 may be folded over in an inverted direction compared to FIG. 2(*d*) against the inner layer 42 of covering 10, and thereafter secured by means of secure stitch 48 as described above for the embodiment of FIG. 2(*d*).

As with the construction of FIG. 2(*b*), it is understood that each end of each of the bands 12 is secured to the associated lower portion of the covering with a construction as shown in FIGS. 2(*d*) and 2(*f*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

A third alternative method of attachment of elastic band 12 for the first embodiment of fitted covering 10 will now be described in detail with reference to FIGS. 2(*a*), 2(*e*) and 2(*g*).

Specifically, referring to FIGS. 2(*a*) and 2(*e*), after application of stitching 44 through the layer including J-shaped hook 36, elastic binding 38 and outer layer 40 of side portion 24, for the embodiment of covering 10 illustrated in FIG. 2(*e*), end 46 of elastic band 12 may be disposed adjacent the top edge of J-shaped hook 36, with band 12 being disposed against inner layer 42 of covering 10. In order to ensure that end 46 of band 12 will not pull away from covering 10 during abnormal use, as discussed for the elastic band attachment method of FIG. 2(*b*), a supplementary securing means may be provided. Referring to FIG. 2(*e*), after stitching by means of stitches 44, a secure stitch 48 comprising the supplementary securing means may be formed by a conventional secure stitch machine so that the secure stitch extends through the layer of elastic band 12, inner layer 42 of side portion 24, elastic binding 38, and outer layer 40 of side portion 24.

Compared to the embodiment of FIG. 2(*e*), for the embodiment of FIG. 2(*g*), elastic band 12 may be attached in an inverted direction compared to FIG. 2(*e*) against the inner layer 42 of covering 10, and thereafter secured by means of secure stitch 48 as described above for the embodiment of FIG. 2(*e*).

As with the construction of FIG. 2(*b*), it is understood that each end of each of the bands 12 is secured to the associated lower portion of the covering with a construction as shown in FIGS. 2(*e*) and 2(*g*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With the construction described above and illustrated in FIGS. 2(*a*) and 2(*c*)-2(*g*), as with the construction of FIG. 2(*b*), even during abnormal use such as yanking and the like, elastic band 12 will remain connected to the covering, and in only rare cases, separate at an intermediate point and be destroyed before the ends of the band will tear away from the covering. Moreover, the provision of the J-shaped hook 36 securely encloses elastic binding 38 to prevent binding 38 from becoming loose, and further encloses elastic binding 38 such that the outer fabric layer 40 of covering 10 has virtually no wrinkles to thereby provide a neat and secure fit on a mattress. Ergonomically, the constructions of FIGS. 2(*a*) and 2(*c*)-2(*g*) also provide a superior elastic fitted covering for which the outer fabric layer 40 encloses elastic band 12 and elastic binding 38, such that in addition to the wrinkle-free fit, elastic band 12 and elastic binding 38 are obscured from view from the general outer surface of covering 10.

With reference to FIGS. 1, 3(*a*)-3(*g*) and 7-9, the second embodiment of fitted covering 100 will now be described in detail.

Specifically, referring to FIG. 1, with elements such as body 20, top portion 22, opposite side portions 24, opposite end portions 26, vertical corners 28, stitching 30 and overlook or safety stitch 32 being similar to those described above for the first embodiment of fitted covering 10, as shown in FIG. 3(*a*), each side portion 24, and likewise each end portion 26, may include a bottom section 34 terminating generally at end 35. As discussed above, a variety of other horizontal or vertical corner formation methods known in the art may be used, and for the fitted covering described herein, instead of vertical or horizontal corners, fitted covering 10 may be of the "cornerless" variety, wherein a single or plural layers of fabric may form the cornerless fitted covering. For the embodiment of FIG. 3(*a*), a cloth binding 37 may be folded over in a mirror-image inverted J-shaped configuration so as to form mirror-image hooks, with the inner J-shaped hook 36' partially enclosing and firmly securing a single layer of elastic binding 38, and the opposite outer J-shaped hook 36" being disposed against the outer surface of side portion 24. It should be noted that instead of the inverted J-shaped configuration illustrated in FIG. 3(*a*), cloth binding 37 may be folded upwards in an inverted U-shaped configuration (not shown). As discussed above for the first embodiment of fitted covering 10, elastic binding 38 may be formed of conventional material used for such elastic binding material in fitted coverings, and may be disposed around the continuous lower edge of the covering and extend at least partially along the length of the lower edge of the covering. Once secured under inner J-shaped hook 36' of cloth binding 37, as described in greater detail below, binding 38 may be secured adjacent side portion 24 and further to inner hook 36' by means of stitching 44. Each end portion 26 of covering 100 may have a similar cloth binding 37 attached thereto, and include the mirror-image hook configuration described above. The lower edges of the side and end portions 24, 26, respectively, may extend lengthwise of the respective portions and spaced from top portion 22 of body 20. The lower edges of side portions 24 may be joined with the lower edges of end portions 26 to form a continuous lower edge of the covering.

With the general configuration of the second embodiment of covering 100 described above in reference to FIG. 3(*a*), the aforementioned mirror-image J-shaped hook configuration will now be used as a basis for a description of the attachment method for elastic band 12.

Specifically, referring to FIGS. 3(*a*) and 3(*b*), before application of stitching 44 for securing binding 38 in place, for the embodiment of covering 100 illustrated in FIG. 3(*b*), end 46 of elastic band 12 may be initially inserted and sandwiched between side portion 24 and elastic binding 38. With elastic band 12 and elastic binding 38 disposed as illustrated in FIG. 3(*b*), the entire assembly including the layer including outer J-shaped hook 36", side portion 24, elastic band 12, elastic binding 38 and the layer including inner J-shaped hook 36' may be stitched by stitching 44.

In order to ensure that end 46 of band 12 will not pull away from covering 100 during abnormal use, a supplementary securing means may be provided. Referring to FIG. 3(*b*), after stitching of band 12 by means of stitches 44, band 12 may be folded over the upper edge of inner J-shaped hook 36' and positioned against the inwardly facing surface of the layer including J-shaped hook 36'. In order to further secure elastic band 12, a secure stitch 48 comprising the supplementary securing means may then be formed by a conventional secure stitch machine so that the secure stitch extends through the first layer of elastic band 12, the fabric layer forming inner J-shaped hook 36', elastic binding 38, the layer including pre-inserted end 46 of band 12, side portion 24, and the fabric layer forming outer J-shaped hook 36".

It is understood that each end of each of the bands 12 is secured to the associated lower portion of the covering with a construction as shown in FIG. 3(*b*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With this construction described above and illustrated in FIGS. 3(*a*) and 3(*b*), even during abnormal use such as yanking and the like, elastic band 12 will remain connected to the covering, and in only rare cases, separate at an intermediate point and be destroyed before the ends of the band will tear away from the covering. Moreover, the provision of the inner J-shaped hook 36' securely encloses elastic binding 38 to prevent binding 38 from becoming loose, and further includes outer J-shaped hook 36" such that the visible area of side portion 24 of covering 100 has virtually no wrinkles to thereby provide a neat and secure fit on a mattress. Ergonomically, the construction of FIGS. 3(*a*) and 3(*b*) also provides a superior elastic fitted covering for which the outer and inner J-shaped hooks 36" and 36', respectively, enclose and conceal elastic band 12 and elastic binding 38, such that in addition to the wrinkle-free fit, elastic band 12 and elastic binding 38 are obscured from view of the general outer surface of covering 100.

A first alternative method of attachment of elastic band 12 for the second embodiment of fitted covering 100 will now be described in detail with reference to FIGS. 3(*a*) and 3(*c*).

Specifically, referring to FIGS. 3(*a*) and 3(*c*), as discussed for the elastic band attachment method of FIG. 3(*b*), before application of stitching 44 for securing binding 38 in place, for the embodiment of covering 100 illustrated in FIG. 3(*c*), end 46 of elastic band 12 may be initially inserted and sandwiched between side portion 24 and elastic binding 38. With elastic band 12 and elastic binding 38 disposed as illustrated in FIG. 3(*c*), the entire assembly including outer J-shaped hook 36", side portion 24, elastic band 12, elastic binding 38 and inner J-shaped hook 36' may be stitched by stitching 44.

In order to ensure that end 46 of band 12 will not pull away from covering 100 during abnormal use, as discussed for the elastic band attachment method of FIG. 3(*b*), a supplementary securing means may be provided. Referring to FIG. 3(*c*), after stitching of band 12 by means of stitches 44, a secure stitch 48 comprising the supplementary securing means may be formed by a conventional secure stitch machine so that the secure stitch extends through the fabric layer forming inner J-shaped hook 36', elastic binding 38, the layer including pre-inserted end 46 of band 12, side portion 24 and the fabric layer forming outer J-shaped hook 36".

As with the construction of FIG. 3(*b*), it is understood that each end of each of the bands 12 is secured to the associated lower portion of the covering with a construction as shown in FIG. 3(*c*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

A second alternative method of attachment of elastic band 12 for the second embodiment of fitted covering 100 will now be described in detail with reference to FIGS. 3(*a*), 3(*d*) and 3(*f*).

Specifically, referring to FIGS. 3(*a*) and 3(*d*), after application of stitching 44 through the layer including inner J-shaped hook 36', elastic binding 38, side portion 24, and the layer including outer J-shaped hook 36", for the embodiment of covering 100 illustrated in FIG. 3(*d*), section 62 of elastic band 12 may be folded over against the fabric of inner J-shaped hook 36'. In order to ensure that end 46 of band 12 will not pull away from covering 100 during abnormal use, as discussed for the elastic band attachment method of FIG. 3(*b*), a supplementary securing means may be provided. Referring to FIG. 3(*d*), after stitching by means of stitches 44, a secure stitch 48 comprising the supplementary securing means may be formed by a conventional secure stitch machine so that the secure stitch extends through the folded over layers of elastic band 12, the fabric layer forming inner J-shaped hook 36', elastic binding 38, side portion 24, and the fabric layer forming outer J-shaped hook 36".

Compared to the embodiment of FIG. 3(*d*), for the embodiment of FIG. 3(*f*), elastic band 12 may be folded over in an inverted direction compared to FIG. 3(*d*) against the fabric layer forming inner J-shaped hook 36', and thereafter secured by means of secure stitch 48 as described above for the embodiment of FIG. 3(*d*).

As with the construction of FIG. 3(*b*), it is understood that each end of each of the bands 12 is secured to the associated lower portion of the covering with a construction as shown in FIGS. 3(*d*) and 3(*f*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

A third alternative method of attachment of elastic band 12 for the second embodiment of fitted covering 100 will now be described in detail with reference to FIGS. 3(*a*), 3(*e*) and 3(*g*).

Specifically, referring to FIGS. 3(*a*) and 3(*e*), after application of stitching 44 through the layer including inner J-shaped hook 36', elastic binding 38, side portion 24, and the layer including outer J-shaped hook 36", for the embodiment of covering 100 illustrated in FIG. 3(*e*), end 46 of elastic band 12 may be disposed adjacent the top edge of inner J-shaped hook 36', with band 12 being disposed against the fabric layer forming inner J-shaped hook 36'. In order to ensure that end 46 of band 12 will not pull away from covering 100 during abnormal use, as discussed for the elastic band attachment method of FIG. 3(*b*), a supplementary securing means may be provided. Referring to FIG. 3(*e*), after stitching by means of stitches 44, a secure stitch 48 comprising the supplementary securing means may be formed by a conventional secure stitch machine so that the secure stitch extends through the layer of elastic band 12, the fabric layer forming inner J-shaped hook 36', elastic binding 38, side portion 24, and the fabric layer forming outer J-shaped hook 36".

Compared to the embodiment of FIG. 3(*e*), for the embodiment of FIG. 3(*g*), elastic band 12 may be attached in an inverted direction compared to FIG. 3(*e*) against the fabric layer forming inner J-shaped hook 36', and thereafter secured by means of secure stitch 48 as described above for the embodiment of FIG. 3(*e*).

As with the construction of FIG. 3(*b*), it is understood that each end of each of the bands 12 is secured to the associated lower portion of the covering with a construction as shown in FIGS. 3(*e*) and 3(*g*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With this construction described above and illustrated in FIGS. 3(*a*) and 3(*c*)-3(*g*), even during abnormal use such as yanking and the like, elastic band 12 will remain connected to the covering, and in only rare cases, separate at an intermediate point and be destroyed before the ends of the band will tear away from the covering. Moreover, the provision of the inner J-shaped hook 36' securely encloses elastic binding 38 to prevent binding 38 from becoming loose, and further includes outer J-shaped hook 36" such that the visible area of side portion 24 of covering 100 has virtually no wrinkles to thereby provide a neat and secure fit on a mattress. Ergonomically, the construction of FIGS. 3(*a*) and 3(*c*)-3(*g*) also provides a superior elastic fitted covering for which the outer and inner J-shaped hooks 36" and 36', respectively, enclose and conceal elastic band 12 and elastic binding 38, such that in addition to the wrinkle-free fit, elastic band 12 and elastic binding 38 are obscured from view of the general outer surface of covering 100.

With reference to FIGS. 1, 4(*a*)-4(*g*) and 7-9, the third embodiment of fitted covering 200 will now be described in detail.

Specifically, referring to FIG. 1, with elements such as body 20, top portion 22, opposite side portions 24, opposite end portions 26, vertical corners 28, stitching 30 and overlook or safety stitch 32 being similar to those described above for the first embodiment of fitted covering 10, as shown in FIG. 4(*a*), each side portion 24, and likewise each end portion 26, may include a bottom section 34 folded over in an inverted U-shaped configuration so as to form a reinforced double fabric layers 52 for securing of elastic binding 38 and elastic band 12. As discussed above, a variety of other horizontal or vertical corner formation methods known in the art may be used, and for the fitted covering described herein, instead of vertical or horizontal corners, fitted covering 10 may be of the "cornerless" variety, wherein a single or plural layers of fabric may form the cornerless fitted covering. For the embodiment of FIG. 4(*a*), as discussed above for the first embodiment of fitted covering 10, elastic binding 38 may be formed of conventional material used for such elastic binding material in fitted coverings, and may be disposed around the continuous lower edge of the covering and extend at least partially along the length of the lower edge of the covering. Once secured adjacent reinforced double fabric layers 52, as described in greater detail below, binding 38 may be secured adjacent outer layer 40 of side portion 24 by means of stitching 44. Each end portion 26 of covering 200 may have a similar lower portion and lower edge, including the hook configuration described above. The lower edges of the side and end portions 24, 26, respectively, may extend lengthwise of the respective portions and spaced from top portion 22 of body 20. The lower edges of side portions 24 may be joined with the lower edges of end portions 26 to form a continuous lower edge of the covering.

With the general configuration of the third embodiment of covering 200 described above in reference to FIG. 4(*a*), the aforementioned reinforced double fabric layers 52 will now be used as a basis for a description of the attachment method for elastic band 12.

Specifically, referring to FIGS. 4(*a*) and 4(*b*), before application of stitching 44 for securing binding 38 in place, for the embodiment of covering 200 illustrated in FIG. 4(*b*), end 46 of elastic band 12 may be initially inserted and sandwiched between the outer layer 40 of side portion 24 and elastic binding 38. With elastic band 12 and elastic binding 38 disposed as illustrated in FIG. 4(*b*), the entire assembly including outer layer 40 of side portion 24, elastic band 12, elastic binding 38 and reinforced double fabric layers 52 may be stitched by stitching 44.

In order to ensure that end 46 of band 12 will not pull away from covering 200 during abnormal use, a supplementary securing means may be provided. Referring to FIG. 4(*b*), after stitching of band 12 by means of stitches 44, band 12 may be folded over the upper edge of reinforced double fabric layers 52 and positioned against the inwardly facing surface of reinforced double fabric layers 52. In order to further secure elastic band 12, a secure stitch 48 comprising the supplementary securing means may then be formed by a conventional secure stitch machine so that the secure stitch extends through the first layer of elastic band 12, reinforced double fabric layers 52, elastic binding 38, the layer including pre-inserted end 46 of band 12 and outer layer 40 of side portion 24.

It is understood that each end of each of the bands 12 is secured to the associated lower portion of the covering with a construction as shown in FIG. 4(*b*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With this construction described above and illustrated in FIGS. 4(*a*) and 4(*b*), even during abnormal use such as yanking and the like, elastic band 12 will remain connected to the covering, and in only rare cases, separate at an intermediate point and be destroyed before the ends of the band will tear away from the covering. Moreover, the provision of the reinforced double fabric layers 52 provides for secure attachment of elastic binding 38 to prevent binding 38 from becoming loose, and further, outer fabric layer 40 encloses elastic binding 38 and elastic band 12 such that side portions 24 have virtually no wrinkles to thereby provide a neat and secure fit on a mattress. Ergonomically, the construction of FIGS. 4(*a*) and 4(*b*) also provides a superior elastic fitted covering for which the outer fabric layer 40 encloses elastic band 12 and elastic binding 38, such that in addition to the wrinkle-free fit, elastic band 12 and elastic binding 38 are obscured from view of the general outer surface of covering 200.

A first alternative method of attachment of elastic band 12 for the third embodiment of fitted covering 200 will now be described in detail with reference to FIGS. 4(*a*) and 4(*c*).

Specifically, referring to FIGS. 4(*a*) and 4(*c*), as discussed for the elastic band attachment method of FIG. 4(*b*), before application of stitching 44 for securing binding 38 in place, for the embodiment of covering 200 illustrated in FIG. 4(*c*), end 46 of elastic band 12 may be initially inserted and sandwiched between the outer layer 40 of side portion 24 and elastic binding 38. With elastic band 12 and elastic binding 38 disposed as illustrated in FIG. 4(*c*), the entire assembly including outer layer 40 of side portion 24, elastic band 12, elastic binding 38 and reinforced double fabric layers 52 may be stitched by stitching 44.

In order to ensure that end 46 of band 12 will not pull away from covering 200 during abnormal use, as discussed for the elastic band attachment method of FIG. 4(*b*), a supplementary securing means may be provided. Referring to FIG. 4(*c*), after stitching of band 12 by means of stitches 44, a secure stitch 48 comprising the supplementary securing means may be formed by a conventional secure stitch machine so that the secure stitch extends through reinforced double fabric layers 52, elastic binding 38, the layer including pre-inserted end 46 of band 12 and outer layer 40 of side portion 24.

As with the construction of FIG. 4(*b*), it is understood that each end of each of the bands 12 is secured to the associated lower portion of the covering with a construction as shown in FIG. 4(*c*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

A second alternative method of attachment of elastic band 12 for the third embodiment of fitted covering 200 will now be described in detail with reference to FIGS. 4(*a*), 4(*d*) and 4(*f*).

Specifically, referring to FIGS. 4(*a*) and 4(*d*), after application of stitching 44 through reinforced double fabric layers 52, elastic binding 38 and outer layer 40 of side portion 24, for the embodiment of covering 200 illustrated in FIG. 4(*d*), section 62 of elastic band 12 may be folded over against the inner layer of reinforced double fabric layers 52. In order to ensure that end 46 of band 12 will not pull away from covering 200 during abnormal use, as discussed for the elastic band attachment method of FIG. 4(*b*), a supplementary securing means may be provided. Referring to FIG. 4(*d*), after stitching by means of stitches 44, a secure stitch 48 comprising the supplementary securing means may be formed by a conventional secure stitch machine so that the secure stitch extends through the folded over layers of elastic band 12, reinforced double fabric layers 52, elastic binding 38, and outer layer 40 of side portion 24.

Compared to the embodiment of FIG. 4(*d*), for the embodiment of FIG. 4(*f*), elastic band 12 may be folded over in an inverted direction compared to FIG. 4(*d*) against the inner layer of reinforced double fabric layers 52, and thereafter secured by means of secure stitch 48 as described above for the embodiment of FIG. 4(*d*).

As with the construction of FIG. 4(*b*), it is understood that each end of each of the bands 12 is secured to the associated lower portion of the covering with a construction as shown in FIGS. 4(*d*) and 4(*f*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

A third alternative method of attachment of elastic band 12 for the third embodiment of fitted covering 200 will now be described in detail with reference to FIGS. 4(*a*), 4(*e*) and 4(*g*).

Specifically, referring to FIGS. 4(*a*) and 4(*e*), after application of stitching 44 through reinforced double fabric layers 52, elastic binding 38 and outer layer 40 of side portion 24, for the embodiment of covering 200 illustrated in FIG. 4(*e*), end 46 of elastic band 12 may be disposed adjacent the top edge of reinforced double fabric layers 52, with band 12 being disposed against the inner layer of reinforced double fabric layers 52. In order to ensure that end 46 of band 12 will not pull away from covering 200 during abnormal use, as discussed for the elastic band attachment method of FIG. 4(*b*), a supplementary securing means may be provided. Referring to FIG. 4(*e*), after stitching by means of stitches 44, a secure stitch 48 comprising the supplementary securing means may be formed by a conventional secure stitch machine so that the secure stitch extends through the layer of elastic band 12, reinforced double fabric layers 52, elastic binding 38, and outer layer 40 of side portion 24.

Compared to the embodiment of FIG. 4(*e*), for the embodiment of FIG. 4(*g*), elastic band 12 may be attached in an inverted direction compared to FIG. 4(*e*) against the inner layer of reinforced double fabric layers 52, and thereafter secured by means of secure stitch 48 as described above for the embodiment of FIG. 4(*e*).

As with the construction of FIG. 4(*b*), it is understood that each end of each of the bands 12 is secured to the associated lower portion of the covering with a construction as shown in FIGS. 4(*e*) and 4(*g*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With this construction described above and illustrated in FIGS. 4(*a*) and 4(*c*) 4(*g*), even during abnormal use such as yanking and the like, elastic band 12 will remain connected to the covering, and in only rare cases, separate at an intermediate point and be destroyed before the ends of the band will tear away from the covering. Moreover, the provision of the reinforced double fabric layers 52 provides for secure attachment of elastic binding 38 to prevent binding 38 from becoming loose, and further, outer fabric layer 40 encloses elastic binding 38 and elastic band 12 such that side portions 24 have virtually no wrinkles to thereby provide a neat and secure fit on a mattress. Ergonomically, the construction of FIGS. 4(*a*) and 4(*c*)-4(*g*) also provides a superior elastic fitted covering for which the outer fabric layer 40 encloses elastic band 12 and elastic binding 38, such that in addition to the wrinkle-free fit, elastic band 12 and elastic binding 38 are obscured from view of the general outer surface of covering 200.

With reference to FIGS. 1, 5(*a*)-5(*f*) and 7-9, the fourth embodiment of fitted covering 300 will now be described in detail.

Specifically, referring to FIG. 1, with elements such as body 20, top portion 22, opposite side portions 24, opposite end portions 26, vertical corners 28, stitching 30 and overlock or safety stitch 32 being similar to those described above for the first-embodiment of fitted covering 10, as shown in FIG. 5(*a*), each side portion 24, and likewise each end portion 26, may include a bottom section terminating generally at end 35. As discussed above, a variety of other horizontal or vertical corner formation methods known in the art may be used, and for the fitted covering described herein, instead of vertical or horizontal corners, fitted covering 10 may be of the "cornerless" variety, wherein a single or plural layers of fabric may form the cornerless fitted covering. For the embodiment of FIG. 5(*a*), as discussed above for the first embodiment of fitted covering 10, elastic binding 38 may be formed of conventional material used for such elastic binding material in fitted coverings, and may be disposed around the continuous lower edge of the covering and extend at least partially along the length of the lower edge of the covering. Once secured adjacent side portion 24, binding 38 may be secured to side portion 24 by means of serge stitching 60. Each end portion 26 of covering 300 may have a similar lower portion and lower edge. The lower edges of the side and end portions 24, 26, respectively, may extend lengthwise of the respective portions and spaced from top portion 22 of body 20. The lower edges of side portions 24 may be joined with the lower edges of end portions 26 to form a continuous lower edge of the covering.

With the general configuration of the fourth embodiment of covering 300 described above in reference to FIG. 5(*a*), the aforementioned configuration of covering 300 will now be used as a basis for a description of the attachment method for elastic band 12.

Specifically, referring to FIGS. 5(*a*) and 5(*b*), after application of serge stitching 60 or other attachment methods to elastic band 12, elastic binding 38 and side portion 24, for the embodiment of covering 300 illustrated in FIG. 5(*b*), section 62 of elastic band 12 may be folded over against elastic binding 38. In order to ensure that end 46 of band 12 will not pull away from covering 300 during abnormal use, a supplementary securing means may be provided. Referring to FIG. 5(*b*), after stitching by means of stitches 60, a secure stitch 48 comprising the supplementary securing means may be formed by a conventional secure stitch machine so that the secure stitch extends through the folded over layers of elastic band 12, elastic binding 38, and side portion 24.

It is understood that each end of each of the bands 12 is secured to the associated lower portion of the covering with a construction as shown in FIGS. 5(*b*) and 5(*d*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

Compared to the embodiment of FIG. 5(*b*), for the embodiment of FIG. 5(*d*), elastic band 12 may be folded over in an inverted direction compared to FIG. 5(*b*) against elastic binding 38, and thereafter secured by means of secure stitch 48 as described above for the embodiment of FIG. 5(*b*).

A second alternative method of attachment of elastic band 12 for the fourth embodiment of fitted covering 300 will now be described in detail with reference to FIGS. 5(*a*), 5(*c*) and 5(*e*).

Specifically, referring to FIGS. 5(*a*) and 5(*c*), after application of serge stitching 60 through elastic band 12, elastic binding 38 and side portion 24, for the embodiment of covering 300 illustrated in FIG. 5(*c*), end 46 of elastic band 12 may be disposed adjacent the top edge of elastic binding 38. In order to ensure that end 46 of band 12 will not pull away from covering 300 during abnormal use, as discussed for the elastic band attachment method of FIG. 5(*b*), a supplementary securing means may be provided. Referring to FIG. 5(*c*), after stitching by means of stitches 60, a secure stitch 48 comprising the supplementary securing means may be formed by a conventional secure stitch machine so that the secure stitch extends through the layer of elastic band 12, elastic binding 38, and side portion 24.

Compared to the embodiment of FIG. 5(*c*), for the embodiment of FIG. 5(*e*), elastic band 12 may be attached in an inverted direction compared to FIG. 5(*c*) against elastic binding 38, and thereafter secured by means of secure stitch 48 as described above for the embodiment of FIG. 5(*c*). Further, for the embodiment of FIG. 5(*f*), elastic band 12 may be attached in an inverted direction compared to FIG. 5(*c*) against the covering between elastic binding 38, and thereafter secured by means of secure stitch 48 as described above for the embodiment of FIG. 5(*c*).

As with the construction of FIG. 5(*b*), it is understood that each end of each of the bands 12 is secured to the associated lower portion of the covering with a construction as shown in FIGS. 5(*c*), 5(*e*) and 5(*f*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With this construction described above and illustrated in FIGS. 5(*a*)-5(*f*), even during abnormal use such as yanking and the like, elastic band 12 will remain connected to the covering, and in only rare cases, separate at an intermediate point and be destroyed before the ends of the band will tear away from the covering. Moreover, the provision of the serge stitching provides for secure attachment of elastic binding 38 to prevent binding 38 from becoming loose, and further, the outer fabric layer hides elastic binding 38 and elastic band 12 such that side portions 24 have virtually no wrinkles to thereby provide a neat and secure fit on a mattress. Ergonomically, the construction of FIGS. 5(*a*)-5(*f*) also provides a superior elastic fitted covering for which the outer fabric layer encloses elastic band 12 and elastic binding 38, such that in addition to the wrinkle-free fit, elastic band 12 and elastic binding 38 are obscured from view of the general outer surface of covering 300. With regard to the construction of FIGS. 5(*a*)-5(*f*), although serge stitching 60 has been described as being used to secure side portion 24, elastic binding 38 and elastic band 12, stitching 60 may alternatively be used to only secure side portion 24 and elastic binding 38, such that secure stitch 48 secures elastic band 12 to the stitched side portion 24 and elastic binding 38.

With reference to FIGS. 1, 6(*a*)-6(*f*) and 7-9, the fifth embodiment of fitted covering 400 will now be described in detail.

Specifically, referring to FIG. 1, with elements such as body 20, top portion 22, opposite side portions 24, opposite end portions 26, vertical corners 28, stitching 30 and overlock or safety stitch 32 being similar to those described above for the first embodiment of fitted covering 10, as shown in FIG. 6(*a*), each side portion 24, and likewise each end portion 26, may include a bottom section 34 terminating generally at end 35. As discussed above, a variety of other horizontal or vertical corner formation methods known in the art may be used, and for the fitted covering described herein, instead of vertical or horizontal corners, fitted covering 10 may be of the "cornerless" variety, wherein a single or plural layers of fabric may form the cornerless fitted covering. For the embodiment of FIG. 6(*a*), a folded layer of elastic binding 38 may be disposed against the inner and outer surfaces of side portion 24. As discussed above for the first embodiment of fitted covering 10, elastic binding 38 may be formed of conventional material used for such elastic binding material in fitted coverings, and may be disposed around the continuous lower edge of the covering and extend at least partially along the length of the lower edge of the covering. Once disposed against the inner and outer surfaces of side portion 24, as described in greater detail below, each layer of binding 38 may be secured adjacent side portion 24 by means of stitching 44. The lower edges of the side and end portions 24, 26, respectively, may extend lengthwise of the respective portions and spaced from top portion 22 of body 20. The lower edges of side portions 24 may be joined with the lower edges of end portions 26 to form a continuous lower edge of the covering.

With the general configuration of the fifth embodiment of covering 400 described above in reference to FIG. 6(*a*), the aforementioned configuration will now be used as a basis for a description of the attachment method for elastic band 12.

Specifically, referring to FIGS. 6(*a*) and 6(*b*), before application of stitching 44 for securing binding 38 in place, for the embodiment of covering 400 illustrated in FIG. 6(*b*), end 46 of elastic band 12 may be initially inserted and sandwiched between side portion 24 and the inner layer of elastic binding 38. With elastic band 12 and elastic binding 38 disposed as illustrated in FIG. 6(*b*), the entire assembly including the inner layer of elastic binding 38, the layer of elastic band 12, side portion 24, and the outer layer of elastic binding 38, may be stitched by stitching 44.

In order to ensure that end 46 of band 12 will not pull away from covering 400 during abnormal use, a supplementary securing means may be provided. Referring to FIG. 6(*b*), after stitching of band 12 by means of stitches 44, a secure stitch 48 comprising the supplementary securing means may be formed by a conventional secure stitch machine so that the secure stitch extends through the inner layer of elastic binding 38, the layer of elastic band 12, side portion 24, and the outer layer of elastic binding 38.

It is understood that each end of each of the bands 12 is secured to the associated lower portion of the covering with a construction as shown in FIG. 6(*b*). Moreover, as illustrated in FIG. 1, four similar elastic bands 12 may be provided, each of these bands being formed of the same material as the binding and extending diagonally across one of the corners of the covering. Alternatively, as apparent to those skilled in the art, each band may be formed of a different material than the binding for varying the elasticity thereof relative to the binding. Each band may have one end thereof secured to one of the side portions 24 of the covering and the opposite end thereof secured to an adjacent end portion 26 of the covering.

With this construction described above and illustrated in FIGS. 6(*a*) and 6(*b*), even during abnormal use such as yanking and the like, elastic band 12 will remain connected to the covering, and in only rare cases, separate at an intermediate point and be destroyed before the ends of the band will tear away from the covering.

A first alternative method of attachment of elastic band 12 for the fifth embodiment of fitted covering 400 will now be described in detail with reference to FIGS. 6(*a*), 6(*c*) and 6(*e*).

Specifically, referring to FIGS. 6(*a*) and 6(*c*), after application of stitching 44 through the inner layer of elastic binding 38, side portion 24, and the outer layer of elastic binding 38, for the embodiment of covering 400 illustrated in FIG. 6(*c*), section 62 of elastic band 12 may be folded over against the inner layer of elastic binding 38. In order to ensure that end 46 of band 12 will not pull away from covering 400 during abnormal use, as discussed for the elastic band attachment method of FIG. 6(*b*), a supplementary securing means may be provided. Referring to FIG. 6(*c*), after stitching by means of stitches 44, a secure stitch 48 comprising the supplementary securing means may be formed by a conventional secure stitch machine so that the secure stitch extends through the folded over layers of elastic band 12, the inner layer of elastic binding 38, side portion 24, and the outer layer of elastic binding 38.

Compared to the embodiment of FIG. 6(*c*), for the embodiment of FIG. 6(*e*), elastic band 12 may be folded over in an inverted direction compared to FIG. 6(*c*) against the inner layer of elastic binding 38, and thereafter secured by means of secure stitch 48 as described above for the embodiment of FIG. 6(*c*).

As with the construction of FIG. 6(*b*), it is understood that each end of each of the bands 12 is secured to the associated lower portion of the covering with a construction as shown in FIGS. 6(*c*) and 6(*e*).

A second alternative method of attachment of elastic band 12 for the fifth embodiment of fitted covering 400 will now be described in detail with reference to FIGS. 6(*a*), 6(*d*) and 6(*f*).

Specifically, referring to FIGS. 6(*a*) and 6(*d*), after application of stitching 44 through the inner layer of elastic binding 38, side portion 24, and the outer layer of elastic binding 38, for the embodiment of covering 400 illustrated in FIG. 6(*d*), end 46 of elastic band 12 may be disposed adjacent the top edge of the inner layer of elastic binding 38, with band 12 being disposed against the inner layer of elastic binding 38. In order to ensure that end 46 of band 12 will not pull away from covering 400 during abnormal use, as discussed for the elastic band attachment method of FIG. 6(*d*), a supplementary securing means may be provided. Referring to FIG. 6(*d*), after stitching by means of stitches 44, a secure stitch 48 comprising the supplementary securing means may be formed by a conventional secure stitch machine so that the secure stitch extends through the layer of elastic band 12, the inner layer of elastic binding 38, side portion 24, and the outer layer of elastic binding 38.

Compared to the embodiment of FIG. 6(*d*), for the embodiment of FIG. 6(*f*), elastic band 12 may be attached in an inverted direction compared to FIG. 6(*d*) against the inner layer of elastic binding 38, and thereafter secured by means of secure stitch 48 as described above for the embodiment of FIG. 6(*d*).

As with the construction of FIG. 6(*b*), it is understood that each end of each of the bands 12 is secured to the associated lower portion of the covering with a construction as shown in FIGS. 6(*d*) and 6(*f*).

With this construction described above and illustrated in FIGS. 6(*a*) and 6(*c*)-6(*f*), even during abnormal use such as yanking and the like, elastic band 12 will remain connected to the covering, and in only rare cases, separate at an intermediate point and be destroyed before the ends of the band will tear away from the covering.

It should be noted that for the various embodiments of the fitted covering described above in reference to FIGS. 1-9, for the embodiments including U-shaped or J-shaped portions, such portions may be folded towards the outer or the inner side of the covering. By way of example, for the J-shaped portion illustrated in FIG. 2(*b*), while J-shaped hook portion 36 has been illustrated as being folded towards the outer side of the covering, as discussed above, portion 36 may likewise be folded in an opposite direction (i.e. towards the inner side of the covering) without departing from the scope of the present invention.

Although particular embodiments of the invention have been described in detail herein with reference to the accompanying drawings, it is to be understood that the invention is not limited to those particular embodiments, and that various changes and modifications may be effected therein by one skilled in the art without departing from the scope or spirit of the invention as defined in the appended claims.

GLOSSARY OF TERMS

10 first embodiment of fitted covering
12 diagonal elastic bands
14 rectangular mattress
16 bottom face
18 opposite upper face
20 body
22 top portion
24 opposite side portions
26 opposite end portions
28 four vertical corners
32 overlock or safety stitch
35 bottom section
34 bottom section
36 I-shaped hook
36' inner J-shaped hook
36" outer I-shaped hook
37 cloth binding
38 Elastic binding
40 outer layer
42 inner layer
44 stitching
46 end of elastic band
48 secure stitch
52 reinforced double fabric layer
60 serge stitching
62 section
100 second embodiment of fitted covering
200 third embodiment of fined covering
300 fourth embodiment of fitted covering

What is claimed is:

1. A fitted mattress covering being one of a fitted sheet, fitted mattress pad and other fitted bed clothing for a mattress, said covering comprising, a fabric body having a top portion, side portions and end portions, said side and end portions having lower edge portions defined by fabric from said side or end portions terminating at a lower edge, said side and end portion lower edges joining one another to form a continuous lower edge of the covering, an elastic binding being disposed adjacent said lower edge portion, said elastic binding extending at least partially along the length of said lower edge of the covering, said binding being secured to said lower edge portions by stitching, an elastic band disposed at each corner of the covering, each band extending diagonally across the associated corner and having opposite ends secured adjacent said elastic binding disposed adjacent said side portions and adjacent one of said adjacent end portions, respectively, said bands being secured in place by at least one of said stitching and by supplementary securing means to ensure that the bands do not pull away from the covering, wherein each end of each of said bands terminating in an end edge which is disposed adjacent said lower edge of the covering, each end of each of said bands being folded over in a generally U-shaped configuration or inverted U-shaped configuration and terminating in an end edge that is respectively coplanar to an upper or lower end of said elastic binding, said supplementary securing means for each end of each of said bands comprising a secure stitch extending through said two folded layers of said band, said binding, and a layer of said lower edge portion.

2. A fitted mattress covering being one of a fitted sheet, fitted mattress pad and other fitted bed clothing for a mattress, said covering comprising, a fabric body having a top portion, side portions and end portions, said side and end portions having lower edge portions defined by fabric from said side or end portions terminating at a lower edge, said side and end portion lower edges joining one another to form a continuous lower edge of the covering, an elastic binding being disposed adjacent said lower edge portion, said elastic binding extending at least partially along the length of said lower edge of the covering, said binding being secured to said lower edge portions by stitching, an elastic band disposed at each corner of the covering, each band extending diagonally across the associated corner and having opposite ends secured adjacent said elastic binding disposed adjacent said side portions and adjacent one of said adjacent end portions, respectively, said bands being secured in place by at least one of said stitching and by supplementary securing means to ensure that the bands do not pull away from the covering, wherein each end of each of said bands terminating in an end edge which is coplanar to an upper or lower end of said elastic binding, said supplementary securing means for each end of each of said bands comprising a secure stitch extending through a layer of said band, said binding, and a layer of said lower edge portion.

* * * * *